US005548267A

United States Patent [19]

Murphy

[11] Patent Number: 5,548,267

[45] Date of Patent: Aug. 20, 1996

[54] THERMOSTAT CONSTRUCTION WITH IMPROVED BI-METALLIC DISK MOUNTING ARRANGEMENT

[75] Inventor: Mark Murphy, Franklin, Tenn.

[73] Assignee: Apcom, Inc., Franklin, Tenn.

[21] Appl. No.: 303,118

[22] Filed: Sep. 8, 1994

[51] Int. Cl.[6] ..... H01H 37/04; H01H 37/52

[52] U.S. Cl. ..... 337/372; 337/380; 337/379

[58] Field of Search ..... 337/365, 372, 337/379, 380, 381

[56] References Cited

U.S. PATENT DOCUMENTS

| | | | |
|---|---|---|---|
| 3,263,049 | 7/1966 | Doherty | 337/381 |
| 3,297,845 | 1/1967 | Mertler | 337/380 |
| 4,079,348 | 3/1978 | Meijer | 337/354 |
| 4,570,148 | 2/1986 | Ferroni | 337/354 |
| 4,754,252 | 6/1988 | Craig | 337/380 |
| 4,952,901 | 8/1990 | Chrupcala | 337/372 |
| 5,285,183 | 2/1994 | Asada | 337/372 |
| 5,296,834 | 3/1994 | Urban | 337/372 |

*Primary Examiner*—Leo P. Picard
*Assistant Examiner*—Stephen T. Ryan
*Attorney, Agent, or Firm*—Paul R. Puerner

[57] ABSTRACT

A thermostatic switch construction including a housing having a switch arm mounted for movement inside. A bi-metallic disk is mounted in the housing and movable in response to temperature change with snap action between two positions of stability. A switch arm actuating plunger is slidably mounted in the housing with its lower end adapted for contact with the bi-metallic snap disk. A bi-metallic disk mounting assembly is provided in which the disk is mounted. The disk housing serves to isolate the bi-metallic disk from contact with any part of the switch housing. The bi-metallic disk housing assembly is comprised of an aluminum platform member and an aluminum cup-shaped cup member mounted thereon to provide an enclosed space in which the bi-metallic snap disk is mounted.

8 Claims, 5 Drawing Sheets

THERMOSTAT CONSTRUCTION WITH IMPROVED BI-METALLIC DISK MOUNTING ARRANGEMENT

BACKGROUND OF THE INVENTION

This invention relates to a bi-metallic snap disk thermostat having an improved bi-metallic disk mounting arrangement to improve the thermal responsiveness of the thermostat operation. This is accomplished by isolating the bi-metal disk from the low thermal conductivity polymeric switch housing. In conventional prior constructions, the bi-metal disk was mounted in contact with the polymeric switch housing. The improvement of the present invention is accomplished by totally enclosing the bi-metal disk in a high thermal conductivity metallic platform.

SUMMARY OF THE INVENTION

A thermostatic switch construction including a housing having a switch arm mounted for movement therein. A bi-metallic snap disk is mounted in the housing and movable with snap action between two positions of stability. A switch arm actuating plunger is slidably mounted in the housing and is adapted for snap movement by the snap disk. A bi-metallic disk housing is provided in which the bi-metallic disk is mounted. The bi-metallic disk housing assembly of metal material serves to isolate the bi-metallic disk from contact with the switch housing to thereby improve the thermal responsiveness of the thermostatic switch.

DESCRIPTION OF THE PREFERRED EMBODIMENT

Figure 1:
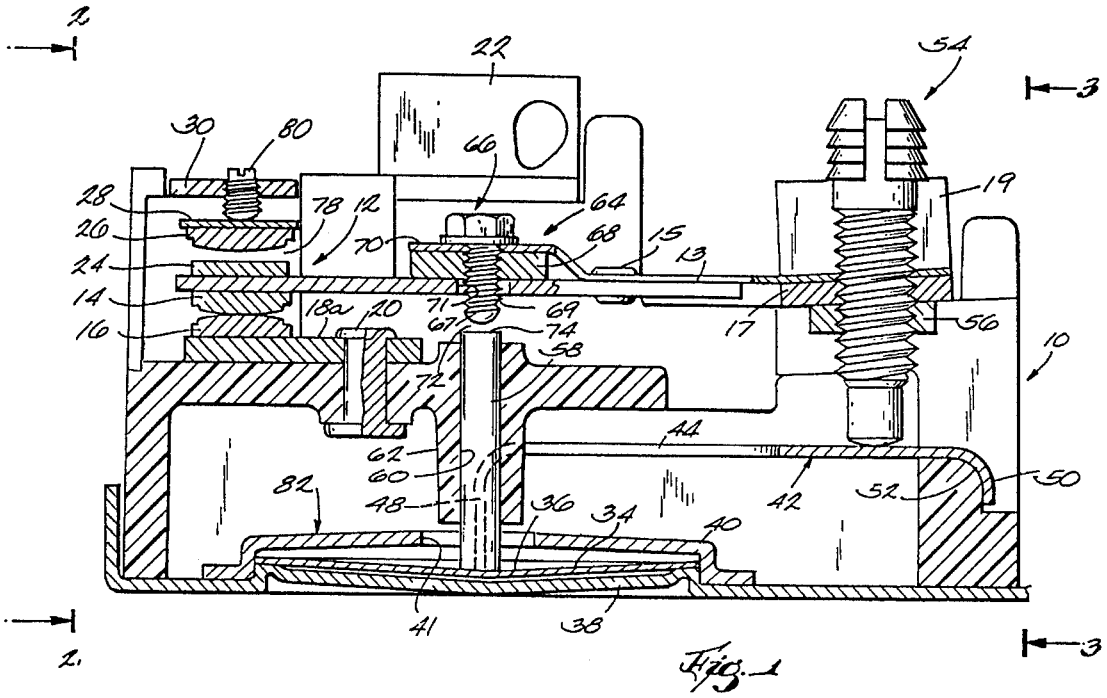
FIG. 1 is a side elevation view with parts broken away of the thermostatic switch of the present invention.

FIGS. 1–16 are enlarged views. Referring to FIG. 1, the thermostat construction of the present invention is comprised of a housing 10 of insulating material having a switch arm 12 mounted therein. Switch arm 12 is fastened to a spring arm 13 by a rivet 15. Spring arm 13 is fastened to the base portion 17 of a terminal fitting 19 by a pair of rivets 21 (see FIG. 3). The end of arm 12 (left hand end as viewed in FIG. 1 ) is free to move up and down and is biased downwardly by spring arm 13.

Figure 2:
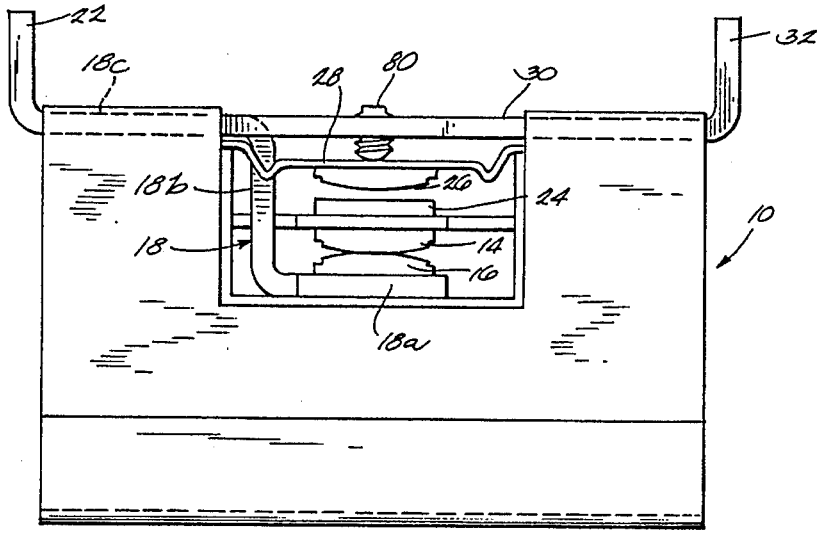
FIG. 2 is an end view of the switch construction shown in FIG. 1 taken along line 2—2 of FIG. 1.
Figure 3:
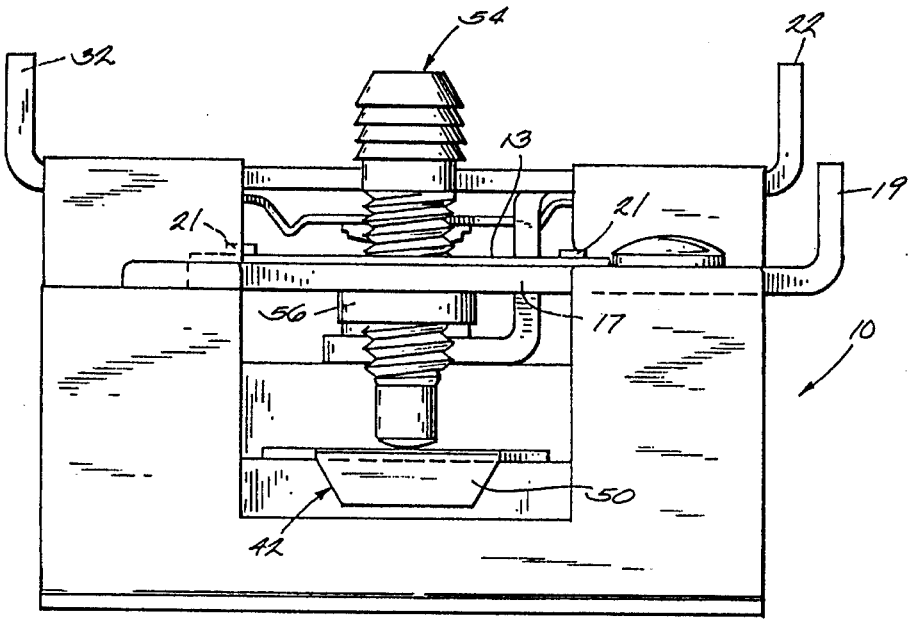
FIG. 3 is an end view of the switch construction shown in FIG. 1 taken along line 3—3 of FIG. 1.

A first pair of operating contacts 14, 16 is provided. Contact 14 is mounted on arm 12 and opposite facing contact 16 is mounted on a stationary member 18. Member 18 is fastened to housing 10 by a rivet 20 and is made of a metal material preferably brass. As best shown in FIGS. 1 and 2, member 18 has a horizontal portion 18*a*, a vertical portion 18*b* extending upwardly from the horizontal portion and a second horizontal portion 18*c* extending horizontally from the top of the vertical portion. The second horizontal portion 18*c* has a terminal 22 formed thereon and adapted for connection to an electrical conductor (not shown). Member 18 provides electrical connection between contact 16 and terminal 22. Contact 14 is biased downwardly into contact with contact 16 by spring arm 13.

A second pair of operating contact members 24, 26 is provided. Contact member 24 is mounted on arm 12 and oppositely facing contact 26 is mounted on a support member 28 which, in turn, is clamped to housing 10 by a metal strap member 30 having a terminal 32 formed thereon as shown in FIG. 2. Members 28 and 30 are made of metal material. Member 28 is preferably made of spring temper phosphor bronze and member 30 is preferably made of brass. Members 28 and 30 provide an electrical connection between the contact 26 and terminal 32 (see FIG. 2) which, in turn, is adapted for connection to an electrical conductor (now shown). Member 28 is flexible.

A bi-metallic snap disk 34 of substantially circular configuration is mounted in the space 36 between a platform member 38 and a cup member 40. The particular construction of the housing assembly for disk 34 in the overall thermostat construction described herein is the principal subject matter of the present invention.

The disk housing assembly as a whole is identified by reference numeral 82. Assembly 82 is comprised of a platform member 38 and a cup-shaped cover member 40.

Platform member 38 (FIGS. 9, 10, 11, 12) is made of metal (preferably aluminum) and has a base portion 84, pairs of raised ring support areas 86, a longitudinal extending depressed rib area 88 and a plurality of upstanding fastening rivet flanges 90. Rib 88 serves both to stiffen the platform member 38 and to provide a support for the center portion of the disk 34.

Figure 11:
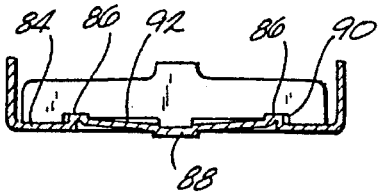
FIG. 11 is a sectional view taken along line 11—11 of FIG. 9.
Figure 12:
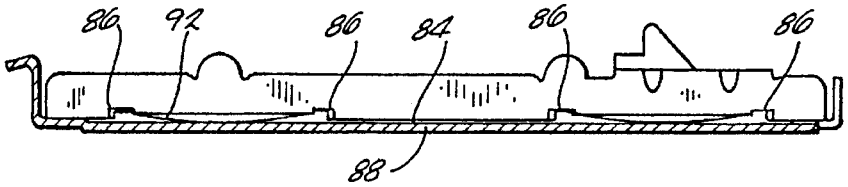
FIG. 12 is a section view taken along line 12—12 of FIG. 9.
Figure 13:
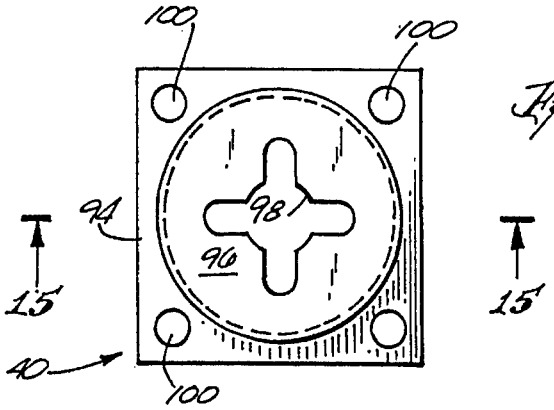
FIG. 13 is a top plan view of the cup member which forms one-half of the metal enclosure for the bi-metallic disk.
Figure 14:
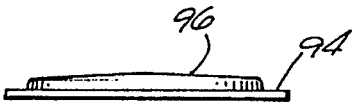
FIG. 14 is a side view of the member shown in FIG. 13.
Figure 15:
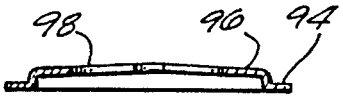
FIG. 15 is a sectional view taken along line 15—15 of FIG. 13.

The areas 92 inside ring areas 86 are deformed downwardly towards center as best shown in FIGS. 11 and 12 and extend parallel to the concave spherical curvature of the bi-metal disk.

Cup-shaped cover members 40 (FIGS. 13, 14, 15, 16) are made of metal, preferably aluminum. The cup members 40 are comprised of a flat base portion 94, a circular dome-shaped raised portion 96 having a cut-out portion 98 in the center thereof. Base portions 94 have a plurality of openings 100 therein.

Figure 4:
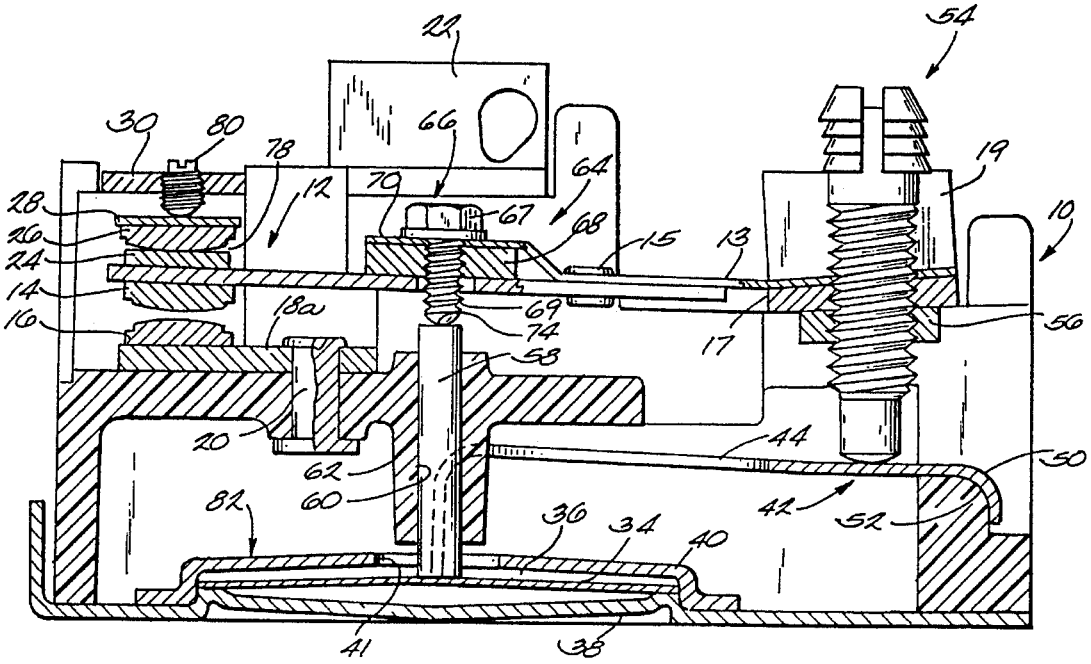
FIG. 4 is a side elevation view of the switch construction shown in FIG. 1 after the bi-metallic disk has been snapped upwardly to operate the switch.
Figure 16:
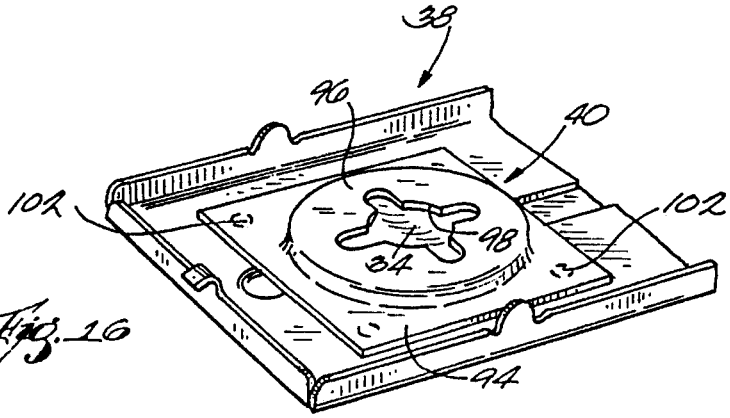
FIG. 16 is a partial plan view of the platform member with the cup member installed thereon.

FIG. 16 is a plan view of platform member 38 with cup member 40 fastened in place and with the bi-metallic disk 34 mounted in the space 36 inside the assembly 82. As best shown in FIG. 1, disk 34 is supported in space 36 on raised ring areas 86 formed in platform member 38. The ends of flanges 90 are flattened as indicated by reference numeral 102 to hold cup member 40 securely in place on platform member 38. FIG. 4 shows the parts of the thermostatic switch after disk 34 snaps over center.

It will be noted from the above description of assembly 82 that the bi-metallic disk mounted inside the assembly is completely isolated from any contact with any part of housing 10. Housing 10 is made of polymeric material and has low thermal conductivity which causes it to heat up and cool down slower than the aluminum platform. The disk only makes contact with portions of the aluminum platform member 38 and the aluminum cup member 40. As a consequence, the sensitivity of the bi-metallic disk to temperature changes is enhanced, resulting in an increased thermal responsiveness of the control function provided by the operation of the thermostatic switch.

Figure 6:
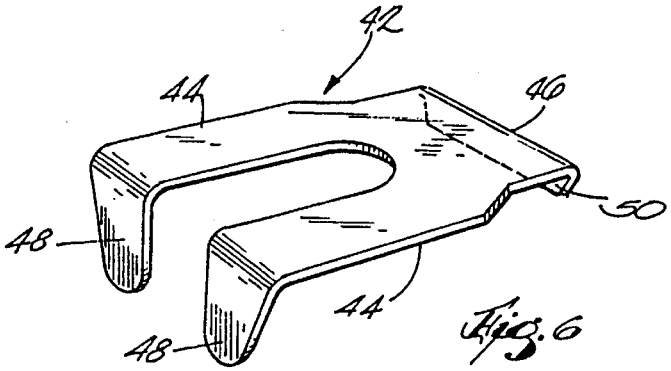
FIG. 6 is a perspective view of the spring member for adjusting the thermostat temperature setting.
Figure 7:
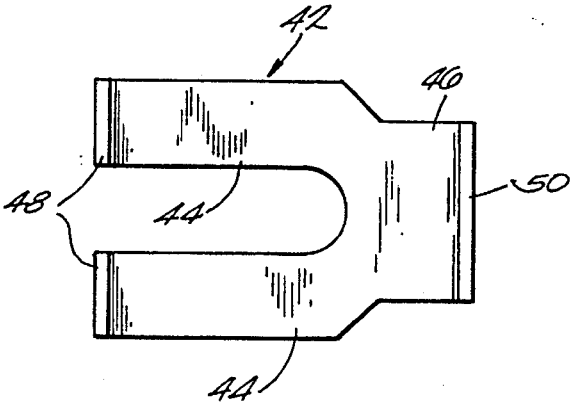
FIG. 7 is a top plan view of the spring member shown in FIG. 6.
Figure 8:
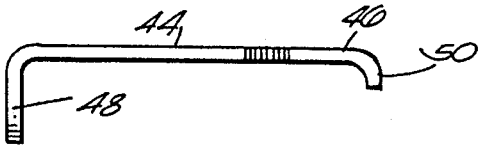
FIG. 8 is a side elevation view of the spring member shown in FIG. 7.
Figure 9:
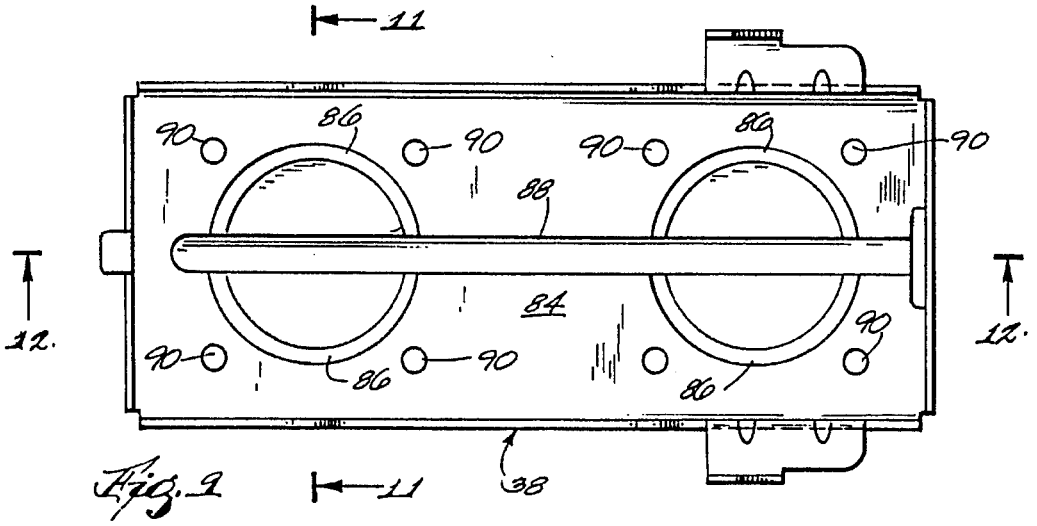
FIG. 9 is a top plan view of the platform member on which the housing is mounted.
Figure 10:
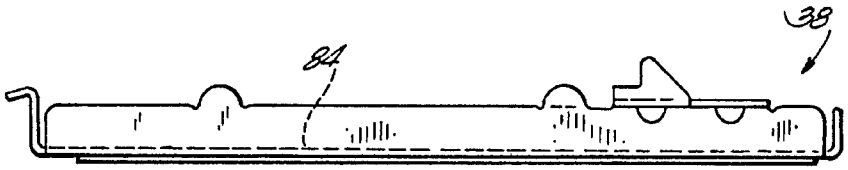
FIG. 10 is a side elevation view of the member shown in FIG. 9.

A one-piece temperature setting adjusting spring member 42 is provided. The configuration of spring member 42 is shown in FIGS. 6, 7 and 8. Member 42 has a pair of spaced arms 44, 44 extending from a support end portion 46. Arms 44, 44 have a pair of downwardly extending bi-metallic disk contacting fingers 48, 48. Support end 46 has a downwardly extending mounting lip 50.

Adjustment spring member 42 is mounted in the switch housing 10 as shown in FIG. 1. As shown, lip 50 rests on and is retained by a rounded support surface 52 formed in the housing 10. Contacting fingers 48, 48 extend through opening 41 in cup member 40 to thereby make contact with the upper face of disk 34.

The pressure exerted by contact fingers 48, 48 on disk 36 can be adjusted by threaded screw member 54 threadably mounted in a threaded collar 56 formed integrally with base portion 17 of terminal fitting 19.

The switch actuating plunger 58 is slidably mounted in an elongated opening 60 formed in cylindrical portion 62 of housing 10.

A "creep" gap set assembly 64 is provided. Assembly 64 is comprised of a creep set screw 66 having a threaded stem portion 69 and a head portion 67 on the end thereof. Set screw 66 is threadably mounted in a nut member 68 which, in turn, is fastened to the end portion 70 of spring arm 13. The threaded portion 69 of creep set screw 66 extends through an opening 71 in switch arm 12.

OPERATION

It is desirable that prior to use, a gap indicated by reference numeral 72 be set between the end 74 of plunger 58 and the end 76 of the threaded portion 69 of set screw 66. The desired gap 72 is set by following the steps as follows:

(a) Turn down creep set screw 66 until contacts 14, 16 open (this can be observed by using an indicator light and electrical source connected between terminal 22 and terminal 19, i.e., the light will go out when the contacts open);

(b) Back off set screw 66 a measured degree of rotation to provide the desired gap 72 as shown in FIG. 1.

(c) The pressure applied on disk 34 by spring member 42 is set by adjustment of threaded screw member 54.

The thermostat is now set for use.

In use, as the heat sensed by bi-metallic disk 34 reaches a predetermined degree, the disk will begin to move slowly upwardly causing the plunger 58 to slide upwardly in opening 60. With the proper settings of the creep set assembly 64 and temperature setting screw 54, disk 34 will snap over center just before the end 74 of plunger 58 makes contact with the end 67 of threaded portion 69 of set screw 66.

The upwardly actuated plunger 58 will cause it to hit the end 67 of the creep set screw which, in turn, will cause contacts 14, 16 to snap open and, at the same time, will cause contacts 24, 26 to snap close. When this occurs, the parts will assume the positions shown in FIG. 4. The opening of contacts 14, 16 will interrupt the electrical circuit between terminals 22 and 19. The closing of contacts 24, 26 will close the electrical circuit between terminals 32 and 19.

Figure 5:
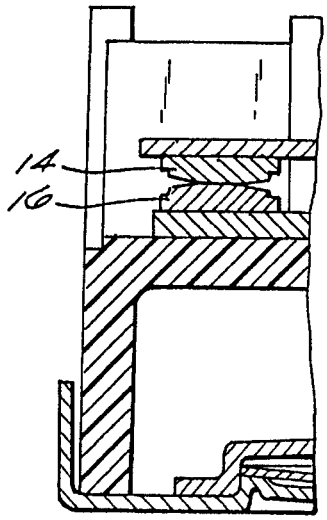
FIG. 5 is fragmentary view showing the switch contact arrangement in a single throw switch embodiment of the invention.

FIG. 5 shows an embodiment of the present invention in a single-throw switch, i.e., double-throw contacts 24, 26 are eliminated. In the double-throw embodiment (FIG. 1), the desired gap 78 between double-throw contacts 24, 26 can be set by adjustment of set screw 80. Set screw 80 is threaded into a threaded opening in member 30.

While the invention has been herein shown and described in what is presently conceived to be the most practical and preferred embodiment, it will be obvious to one or ordinary skill in the art that modifications may be made thereof within the scope of the invention, which scope is not to be limited except by the appended claims.

I claim:

1. A thermostatic switch construction comprising:

(a) a switch housing means (10);

(b) a switch arm means (12) mounted for movement in said switch housing;

(c) a bi-metallic snap disk means (34) movable with snap action between two positions of stability to actuate said switch arm means;

(d) a bi-metallic disk housing assembly (82) in which said bi-metallic snap disk means is mounted, said bi-metallic disk housing assembly serving to isolate said bi-metallic snap disk from contact with any part of the switch housing means (10), said disk housing assembly is comprised of a metal platform member (38) and a metal cup-shaped cover member (40) mounted thereon to provide an enclosed space (36) in which said bi-metallic snap disk is mounted, said snap disk movable between its two positions of stability without making contact with said cup-shaped cover member.

2. A thermostatic switch construction according to claim 1 in which the material of said platform member and said cover member is aluminum.

3. A thermostatic switch construction according to claim 1 in which said cup-shaped member has an opening in the top thereof through which said snap disk can make operable engagement with said switch arm means.

4. A thermostatic switch construction comprising:

(a) a switch housing means (10);

(b) a switch arm means (12) mounted for movement in said switch housing;

(c) a bi-metallic snap disk means (34) movable with snap action between two positions of stability to actuate said switch arm means;

(d) a switch arm actuating plunger means (58) adapted for movement by said disk means; and (e) a bi-metallic disk housing assembly (82) in which said bi-metallic disk means is mounted, said bi-metallic disk housing assembly serving to isolate said bi-metallic snap disk from contact with any part of the switch housing means (10), said disk housing assembly is comprised of a metal platform member (38) and a metal cup-shaped cover member (40) mounted thereon to provide an enclosed space (36) in which said bi-metallic snap disk is mounted, said snap disk movable between its two positions of stability without making contact with said cup-shaped cover member.

5. A thermostatic switch construction according to claim 4 in which the material of said platform member and said cover member is aluminum.

6. A thermostatic switch construction according to claim 4 in which said cup-shaped member has an opening in the top thereof through which said snap disk can make operable engagement with said switch arm actuating plunger (58).

7. A thermostatic switch construction comprising:

(a) a switch housing means (10);

(b) a switch arm means (12) mounted for movement in said switch housing;

(c) a bi-metallic snap disk means (34) movable with snap action between two positions of stability to actuate said switch arm means;

(d) a bi-metallic disk housing assembly (82) in which said bi-metallic snap disk means is mounted, said bi-metallic disk housing assembly serving to isolate said bi-metallic snap disk from contact with any part of the switch housing means (10), said disk housing assembly is comprised of a platform member (38) and a cup-shaped cover member (40) mounted thereon to provide an enclosed space (36) in which said bi-metallic snap disk is mounted, said platform member has a longitudinally extending depressed rib area (88) which serves both to stiffen the platform member and to provide a support for the center portion of the bi-metallic disk.

8. A thermostatic switch construction comprising:

(a) a switch housing means (10);

(b) a switch arm means (12) mounted for movement in said switch housing;

(c) a bi-metallic snap disk means (34) movable with snap action between two positions of stability to actuate said switch arm means;

(d) a switch arm actuating plunger means (58) adapted for movement by said disk means; and (e) a bi-metallic disk housing assembly (82) in which said bi-metallic disk means is mounted, said bi-metallic disk housing assembly serving to isolate said bi-metallic snap disk from contact with any part of the switch housing means (10), said disk housing assembly is comprised of a platform member (38) and a cup-shaped cover member (40) mounted thereon to provide an enclosed space (36) in which said bi-metallic snap disk is mounted, said platform member has a longitudinally extending depressed rib area (88) which serves both to stiffen the platform member and to provide a support for the center portion of the bi-metallic disk.

* * * * *